United States Patent [19]

Webber

[11] Patent Number: 4,602,759

[45] Date of Patent: Jul. 29, 1986

[54] MAGAZINE STAND

[76] Inventor: Paul W. Webber, 2506 20th Ave. N., Texas City, Tex. 77590

[21] Appl. No.: 729,208

[22] Filed: May 1, 1985

[51] Int. Cl.[4] ..... A47B 97/04

[52] U.S. Cl. ..... 248/447; 211/133

[58] Field of Search ..... 248/447, 371; 211/71, 211/16, 85, 126, 133, 132, 195; 312/37; 108/32; 242/28, 55.2

[56] References Cited

U.S. PATENT DOCUMENTS

| | | | |
|---|---|---|---|
| 1,902,549 | 3/1933 | Flanagan | 248/447 |
| 2,050,638 | 8/1936 | Tuthill | 211/133 X |
| 2,063,393 | 12/1936 | McIver | 211/133 X |
| 2,192,102 | 2/1940 | Pinto | 211/126 |
| 2,198,459 | 4/1940 | Potts | 211/126 X |
| 2,248,369 | 7/1941 | Ludersen | 248/371 |
| 2,614,698 | 10/1952 | Bell | 211/62 |
| 3,275,279 | 9/1966 | Caldwell | 248/447 |
| 3,568,850 | 3/1971 | Rogers | 211/71 |

*Primary Examiner*—Ramon S. Britts
*Assistant Examiner*—Sarah A. Lechok Eley
*Attorney, Agent, or Firm*—Bill B. Berryhill

[57] ABSTRACT

A magazine stand which includes: a base by which the stand is supported on the floor; elongated support members extending upwardly from the base; and a table hingedly attached to the upper end of the support members for pivoting from a generally horizontal first position, in which magazines may be placed thereon for reading, to a generally vertical second position allowing easier access to portions of the stand below the table.

3 Claims, 4 Drawing Figures

MAGAZINE STAND

BACKGROUND OF THE INVENTION

1. Field of the Invention

The present invention pertains to magazine stands. More specifically, the invention pertains to specialty magazines stands designed for associated purposes.

2. Description of the Prior Art

There are a number of designs of magazines stands. The differences in designs are normally in the appearance. This is probably due to the fact that most magazine stands are designed for a single purpose, i.e. the holding of magazines. If designed for such, magazines stands may have more than one purpose. Since magazines are often kept in bathrooms, a magazine stand constructed with associated uses would be desirable. This would particularly be true in restrooms perhaps not as well equipped as others, e.g. mobile homes, vacations cottages, recreational vehicles, etc.

SUMMARY OF THE PRESENT INVENTION

The present invention provides a magazine stand which is also designed to support individual magazines on a table for reading. In addition, it may be provided with a toilet tissue holder or other components for supporting coffee cups, etc.

The magazine stand of the present invention may include a base or container which is divided into compartments for holding magazines and a table which is supported above the base by support members. The table may be hingedly attached to the upper end of the support members for pivoting from a generally horizontal first position, in which magazines may be placed thereon for reading, to a generally vertical second position allowing easier access to portions of the stand below the table. A toilet tissue holder may be mounted beneath the table, when in the reading position, but easily accessible from one side of the stand when the table is in the second position.

Thus, the magazine stand of the present invention not only serves the purpose of storing magazines, it also provides a table on which individual magazines may be placed for reading and it ay support toilet tissue or other items for associated use. The construction of the magazine stand allows it to be easily moved from place to place. In addition, it is relatively inexpensive yet quite useful. Other objects and advantages of the invention will be apparent fromthe description which follows in conjunction with the accompanying drawings.

DESCRIPTION OF PREFERRED EMBODIMENTS

Figure 1:
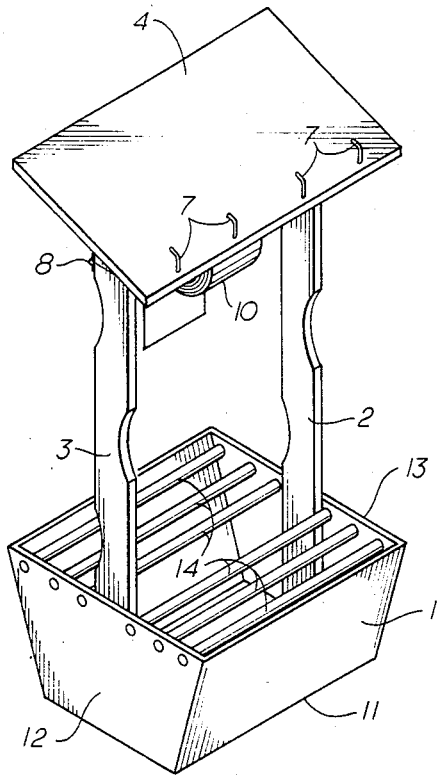
FIG. 1 is a perspective view of the magazine stand of the present invention according to a preferred embodiment thereof.
Figure 2:
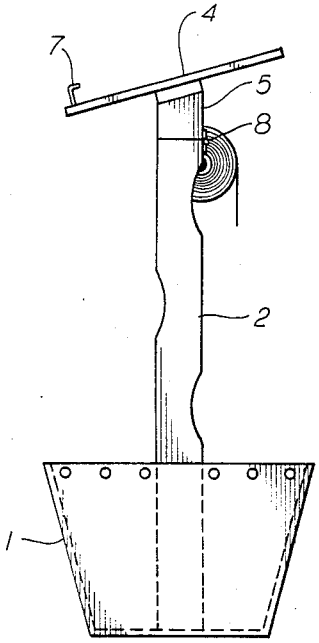
FIG. 2 is an elevational end view of the magazine stand of the present invention, according to a preferred embodiment thereof.
Figure 3:
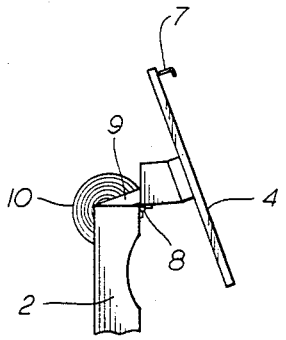
FIG. 3 is a partial elevational end view similar to FIG. 2, but showing the table means thereof in a second position.

Referring first to FIGS. 1, 2, and 3, the magazine stand of the present invention comprises a base 1, by which the stand may be supported on the floor. Elongated support members 2 and 3, the lower ends of which are attached to the base 1, extend upwardly therefrom. A table 4 isattached to the upper ends of the support members 2 and 3. The tabel 4 may be provided with downwardly projecting extensions 5 which may be attached to the support members 2 and 3 by hinges 8 so as to allow the table 4 to pivot from a generally horizontal slightly slanted first position, as shown in FIGS. 1 and 2, in which magazines may be placed thereon for reading, to a generally vertical second position (see FIG. 3) allowing easier access to portions of the stand below the table 4. It will be noted that stop means or member 7 may be provided along one edge of the slanted table 4 to prevent magazines placed thereon from sliding off.

A toilet tissue holder 9 may be mounted beneath the table 4 for holding a roll of toilet tissue 10 thereon. It is noted that the toilet tissue holder 9 is mounted beneath the table 4 when in the first position of FIGS. 1 and 2, but that the toilet tissue holder is easily accessible from one side of the stand when the table is in the second position of FIG. 3.

The base 1 comprises a container which includes a bottom 11 and at least two opposing side walls 12 and 13 extending upwardly therefrom. The container may comprise a plurality of divided compartments partially definable by side walls 12, 13 and divider means 14 extending therebetween.

Figure 4:
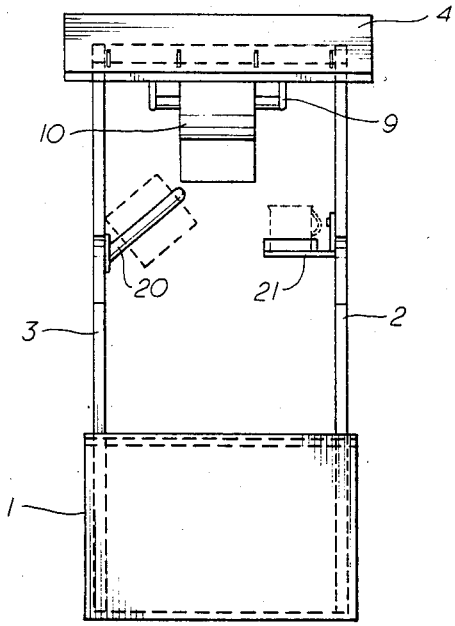
FIG. 4 is a front elevation view of the magazine stand of the present invention according to an alternate embodiment thereof.

As seen in the alternate embodiment of FIG. 4, additional components, such as the spare toilet tissue holder 20 and the coffee cup holder 21, are provided. Other components may be attached to the stand.

Thus, the magazine stand of the present invention may serve several functions, i.e. storing of magazines, providing a reading surface for magazines, storing of toilet tissue, etc. The design is extremely functional, practical and pleasing in appearance. Many variations thereof may be made without departing from the spirit of the invention. Accordingly, it is intended that the scope of the invention be limited only by the claims which follow.

I claim:

1. A magazine stand comprising:

base means by which said stand may be supported on the floor;

said base means comprises a container divided into compartments in which a plurality of magazines may be separately stored for easy selection, a pair of spaced apart elongated support members having upper and lower ends, the lower ends of which are attached to said base means so that said support members extend upwardly therefrom;

table means pivotally attached to the upper end of each of said support members for pivoting from a generally horizontal first position, in which the magazine may be placed thereon for reading, to a generally vertical second position, allowing easier access to sections of said stand below said table means; and a toilet tissue holder attached to the underside of said table means so that, upon movement of said table means to said second position, said toilet tissue holder projects outwardly from said stand, and at least one accessory support means attached to at least one of said support memebers in the space between said support members for supporting accessory items on said stand.

2. A magazine stand as set forth in claim 1 in which said table means, when in said first position, is slightly inclined so that one edge thereof is slightly lower than the opposite edge thereof.

3. A magazine stand as set forth in claim 1 in which said one edge of said table means is provided with stop means to prevent magazines placed on said table means from sliding off.

* * * * *